United States Patent [19]

Jido

[11] Patent Number: 4,508,265

[45] **Date of Patent: * Apr. 2, 1985**

[54] METHOD FOR SPRAY COMBINATION OF LIQUIDS AND APPARATUS THEREFOR

[75] Inventor: Morio Jido, Tokyo, Japan

[73] Assignees: Agency of Industrial Science & Technology; Ministry of International Trade & Industry, both of Tokyo, Japan

[ * ] Notice: The portion of the term of this patent subsequent to May 17, 2000 has been disclaimed.

[21] Appl. No.: 356,086

[22] Filed: Mar. 8, 1982

[30] Foreign Application Priority Data

Jun. 18, 1981 [JP] Japan ..... 56-94157

[51] Int. Cl.[3] ..... B05B 5/02

[52] U.S. Cl. ..... 239/3; 239/696; 239/708

[58] Field of Search ..... 239/3, 145, 424, 696, 239/708; 366/176, 154

[56] References Cited

U.S. PATENT DOCUMENTS

| | | | |
|---|---|---|---|
| 2,971,700 | 2/1961 | Peeps | 239/424 |
| 3,698,635 | 10/1972 | Sickles | 239/3 |
| 3,930,061 | 12/1975 | Scharfenberger | 239/3 |
| 4,014,469 | 3/1977 | Sato | 239/424 |
| 4,034,966 | 7/1977 | Suh et al. | 366/176 |
| 4,117,550 | 9/1978 | Folland et al. | 366/176 |
| 4,266,721 | 5/1981 | Sickles | 239/3 |
| 4,383,767 | 5/1983 | Jido | 366/154 |

FOREIGN PATENT DOCUMENTS

| | | | |
|---|---|---|---|
| 4523238 | 7/1965 | Japan | 239/145 |

*Primary Examiner*—Jeffrey V. Nase
*Assistant Examiner*—Jon M. Rastello
*Attorney, Agent, or Firm*—Kurt Kelman

[57] ABSTRACT

Spray combination of two liquids is advantageously accomplished by applying a high potential of one polarity to a first liquid thereby converting the first liquid into finely divided ionized particles, spraying a second liquid through a porous member and applying thereto a high potential of the other polarity thereby converting the second liquid into finely divided ionized particles, and combining the two masses of finely divided particles of the two liquids electrostatically with each other.

7 Claims, 6 Drawing Figures

METHOD FOR SPRAY COMBINATION OF LIQUIDS AND APPARATUS THEREFOR

BACKGROUND OF THE INVENTION

This invention relates to a method for spray combining two liquids uniformly by utilizing the action of corona discharge or an electric field and to an apparatus for working the method.

The development of a technique capable of electrostatically combining two liquids in a sprayed form has been desired in various fields. The technique is found necessary where two liquids which cannot easily be emulsified or solubilized without use of a surfactant are to be combined to form a mixture, where water is to be added in a uniformly dispersed state to gasoline or kerosene as a fuel for the purpose of lowering the occurrence of $NO_x$, or when an alcohol is to be added to oil to save oil, for example.

Heretofore, the combination of two liquids has been accomplished by use of a surfactant proper to the nature of the liquids involved or by means of a mechanical force. Some, if not all, liquids being combined may abhor contact with a surfactant. Even when two liquids are combined by means of a mechanical force, no effective combination is obtained unless the machine in use is operated under a complicated combination of precisely selected conditions. In view of these difficulties, the inventors previously proposed a method for the combination of two substances by the steps of finely dividing the two substances separately by corona discharge under mutually reverse polarities and bringing the two masses of finely divided particles of opposite polarity into contact with each other U.S. Pat. No. 4,383,767, granted May 17, 1983, to Jido.

SUMMARY OF THE INVENTION

An object of this invention is to provide a method for uniformly combining a plurality of liquids while retaining the liquids in a sprayed state and to an apparatus for working the method.

To accomplish the object according to the present invention, there is provided a method which comprises ionizing a first liquid under application of a high potential thereby ejecting the liquid in the form of finely divided particles, ejecting a second liquid through a porous substance and applying to the ejected finely divided particles a high potential of opposite polarity thereby ionizing the ejected finely divided particles, electrostatically combining the two masses of finely divided particles thereby neutralizing them electrically and mixing them both in finely divided form.

By the method of this invention, the two liquids are very smoothly combined in a finely divided form because they are each converted into finely divided particles and the two masses of finely divided particles so produced are charged to opposite polarities as described above.

The other objects and characteristics of this invention will become apparent from the further disclosure of the invention to be made hereinbelow with reference to the accompanying drawing.

DESCRIPTION OF PREFERRED EMBODIMENT

Figure 1:
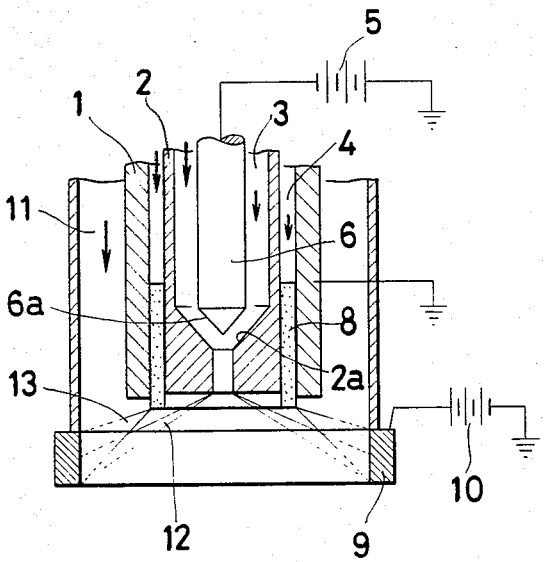
FIG. 1 is a cross section of an apparatus of this invention used for the spray combination of two liquids.
Figure 2:
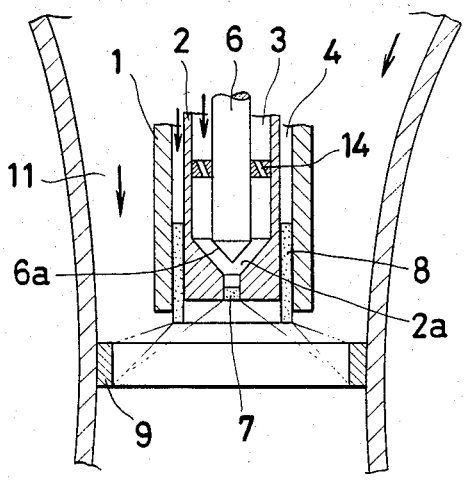
FIG. 2 is a cross section of the apparatus of this invention for the spray combination of two liquids, as applied to a mixed gas combustion system.

FIG. 1 illustrates one embodiment of the apparatus of this invention for the spray combination of two liquids. An inner tube 2 is concentrically disposed inside an outer tube 1 of a grounded spray nozzle. The inner wall surface of the outer tube 1 and the outer wall surface of the inner tube 2 define an annular second flow path 4, while the interior of the inner tube 2 constitutes a first flow path 3. At the center of the first flow path 3 is disposed a discharge electrode 6 for corona discharge to which a power source 5 applies a high negative potential. A conical discharge surface 6*a* at the leading end of the electrode is opposed to a conical discharge surface 2*a* formed on the leading inner surface of the inner tube 2. In the ejection aperture of the aforementioned first flow path at the leading end of the inner tube 2, a porous member 7 such as porous metal is disposed as occasion demands (FIG. 2). The second annular flow path 4 formed concentrically around the outer surface of the flow path 3 opens around the ejection aperture of the aforementioned first flow path 3 past a porous member 8 such as porous metal. Toward the leading end of the outer tube of the spray nozzle, an annular discharge electrode 9 is disposed around the aforementioned ejection aperture. This discharge electrode 9 is connected to a power source serving to apply a high positive potential. Between the aforementioned electrode 9 and the outer tube 1, there is formed a flow path 11 for delivering a forced current of fluid generated such as by a fan (not shown).

In the spray combination apparatus constructed as described above, when a liquid such as gasoline or kerosene which has a low dielectric constant is supplied under pressure or its own weight to the first flow path 3, it gradually passes through the gap between the discharge surface 6*a* of the electrode 6 and the discharge surface 2*a* of the inner tube 2. Since a high negative potential is applied to the aforementioned electrode 6, an electric field is formed between the discharge surfaces 6*a*, 2*a* and, at the same time, corona discharge occurs through the medium of the liquid flowing through the flow path 3. Consequently, the liquid is fluidized, divested of its surface tension, and further ionized owing to the action of the electric field. Thus, the liquid is ejected in the form of finely divided charged particles through the open end of the first flow path 3. By selection of suitable conditions, the angle of ejection of the liquid can be increased even beyond 150°. The path of the sprayed liquid has the shape of a hollow cone.

When the porous member 7 is disposed at the open end of the first flow path 3 as illustrated in FIG. 2, it serves to uniformize the finely divided particles being ejected to a regulated size. The particle size of the finely divided liquid being sprayed decreases with the decreasing diameter of the pores distributed in the porous member. The finely divided charged particles ejected through the open end repel each other because they are charged in the same polarity. The angle within which these particles are sprayed through the open end, therefore, depends on the force with which they repel each other. The aforementioned porous member 7 is required to be such that it does not discharge the electric charge of the liquid being passed therethrough. When this porous member 7 is made of a metallic material such as porous metal as described above, the possibility of discharging the electric charge poses no serious problem so long as the inner pores formed therein for the passage of the liquid have a relatively small length.

Since the finely divided particles 12 of the liquid sprayed in the form of a hollow cone through the open end of the first flow path 3 are charged in one same polarity, the individual particles do not combine but retain their dispersed state.

In the meantime, to the second flow path 4, a dielectric liquid such as an alcohol is applied under pressure or its own weight. The liquid is then ejected through the porous member 8. Again in this case, the particle size of the liquid ejected decreases with decreasing diameter of the pores in the porous member. When a porous metal having a pore diameter of about 10 μm is used, for example, the greater part of the finely divided particles of the liquid 13 sprayed through this porous metal are gasified before they reach the discharge electrode 9. By suitably selecting the distance between the leading end of the porous member 8 serving to spray the liquid and the electrode 9 and the pore diameter of the porous member 8, the sprayed finely divided particles undergo secondary splitting and become much finer particles. The size of the finely divided particles of liquid can be determined by the magnitude of applied potential, the pore diameter of porous member, the feed rate of liquid to the flow path, the distance to the electrode, etc.

The aforementioned sprayed finely divided particles 13 are attracted in the form of a hollow cone to the annular discharge electrode 9 and electrically charged and consequently converted into finely divided charged particles 13 having the polarity of the electrode 9. Because of the repulsive force generated between the particles, these finely divided charged particles 13 are dispersed in an atomized state. When the finely divided particles 13 are delivered forward by the liquid passing through the flow path 11, they are combined with the finely divided particles 12 of liquid ejected through the first flow path 3. In this case, since high potentials of opposite polarity are applied to the electrodes 6, 9, the finely divided charged particles of the two liquids are charged to opposite polarities. Consequently, an electrostatic attractive force is exerted upon the finely divided charged particles and the finely divided charged particles held so far in a dispersed state are combined with one another. The supply of a liquid to the first or second flow path can be effected under pressure or under the liquid's own weight, whichever may be more convenient. When the liquid is supplied under pressure, the fineness of the particles formed by spraying can be enhanced by increasing the pressure being applied.

Concerning the relation between the potentials applied to the two electrodes 6, 9, the spray formed by the combination of the two masses of finely divided charged particles can be electrically neutralized by suitably selecting the potentials, etc. applied to the electrodes. The measure taken for electrically neutralizing the formerly charged spray is effective for preventing a subsequent apparatus designed to make use of the product of spray combination from being electrically charged and exposing the operator to the danger of electric shock.

The finely divided charged particles 12 ejected through the first flow path 3 are then passed through an electric field formed by the discharge electrode 9. The effect of the electric field upon the finely divided charged particles can be substantially eliminated by suitably setting the intensity of this electric field.

As the porous member to be disposed at the open end of the first flow path 3 and that of the second flow path 4, a sintered metal obtained from powdered brass or stainless steel can be advantageously used. Porous substances of such sintered metals having varying pore diameters above a minimum of about 10 μm are commercially available. A particular porous substance of sintered metal having a pore diameter suitable for the particular spray combination aimed at may be selected. While the size of the porous member 8 formed in the second flow path 4 is not specifically limited, that of the porous member 7 disposed in the first flow path 3 is required to be such that the porous member does not discharge the electric charge of the liquid being passed therethrough.

In accordance with this invention, since two masses of finely divided oppositely charged particles are combined with each other as described above, liquids which cannot be easily emulsified or solubilized can be uniformly combined without use of any dispersant. The resultant mixture can be delivered to a subsequent process in the form of a mass of finely divided neutral particles.

Now, an application of this invention to a mixed gas combustion system such as, for example, a gasoline engine will be described with reference to FIG. 2. In this case, the fuel such as gasoline, kerosene, or alcohol to be delivered to the combustion chamber is required to be vaporized into the state of a gas in advance.

The gasoline which is supplied from a fuel pump (not shown) is fed to the first flow path 3, swirled by means of swirl slots 14, and passed over the discharge surfaces *2a*, *6a* to be electrically charged in one polarity thereby. The gasoline is then passed through the porous member 7 to be ejected in the form of a hollow cone consisting of finely divided particles.

An alcohol to be used as fuel additive is supplied to the second flow path 4, electrically charged by the electric field formed between the leading end of the porous member 8 and the annular electrode 9 and consequently subjected to secondary splitting, and attracted to the electrode 9 as converted into finely divided particles. Through the flow path 11, a large-volume, swirled current of air is supplied. The two masses of finely divided particles of vaporized fuels charged to opposite polarities are combined with each other within the swirled air current, neutralized, converted into a mixed-gas fuel carried on the air current, and forwarded to the combustion chamber (not shown) of the combustion system.

Figure 3:
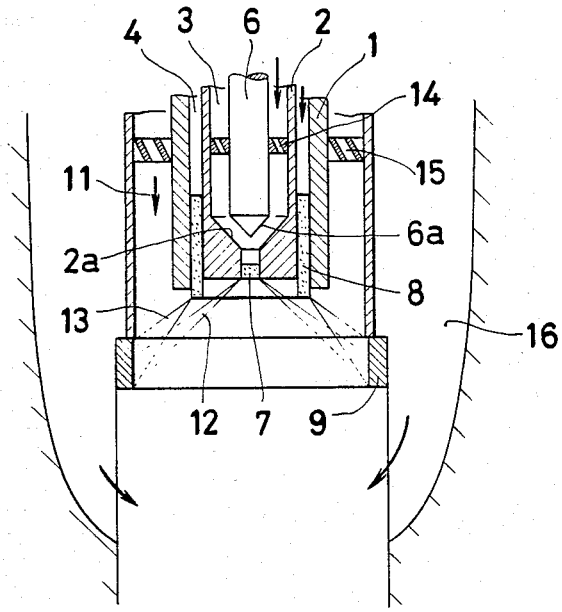
FIG. 3 is a cross section of the apparatus of this invention for the spray combination of two liquids, as applied to a direct combustion system.

An application of the present invention to a direct combustion system such as a gas turbine combustor is illustrated in FIG. 3. In this case, the hydrocarbon used as the main fuel is supplied from a fuel injection pump (not shown) into the first flow path 3, swirled by means of swirl slots 14, electrically charged in one polarity by the electric field of a high intensity formed between the discharge surfaces 6*a*, 2*a*, and then passed through the porous member 8 to be ejected in the form of finely divided particles into the ambient air. An auxiliary fuel (a mixture of 30 parts of alcohol and 100 parts of water) is supplied to the second flow path 4 and electrically charged in the opposite polarity by the electric field formed between the porous member 8 and the annular electrode 9. Through the flow path 11, primary air swirled by swirl vanes 15 is brought in. In the swirled air current, the two masses of finely divided particles having opposite polarities are combined with each other and neutralized, then mixed with secondary air supplied through a flow path 16. The final mixture thus formed is transferred to the combustor (not shown). Within the combustor, the combined fuel obtained as described above is burnt explosively at a notably elevated temperature with greatly improved efficiency.

Figure 4:
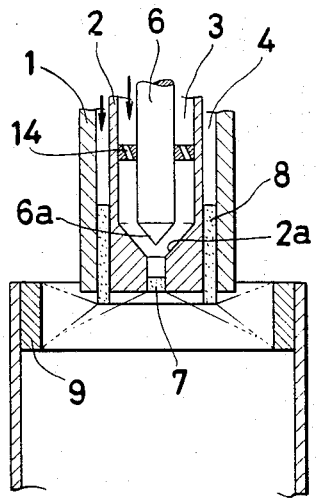
FIG. 4 is a cross section of the apparatus of this invention for the spray combination of two liquids, as applied to a direct jet combustion system.

An application of the present invention to a combustion system by direct fuel injection as in a diesel engine is illustrated in FIG. 4. In this case, the main fuel is supplied in a compressed state to the first flow path 3, electrically charged in one polarity by the cooperation of the discharge surfaces 6*a*, 2*a*, and passed through the porous member 7 to be ejected in the form of finely divided particles into an atmosphere maintained at an elevated temperature under high pressure. In the meantime, a hydrophilic fuel (a mixture of 30 parts of alcohol and 100 parts of water) is supplied through the second flow path 4. The fuel which is ejected through the porous member 8 is electrically charged in the opposite polarity by the annular electrode 9 and converted into finely divided particles. The two masses of finely divided particles of opposite polarity are combined with each other and forwarded to the combustion chamber (not shown) of the combustion system. Since the main fuel and the hydrophilic fuel are combined uniformly with each other and the resultant uniform mixture is supplied in a still finely divided form to the combustion chamber, the fuel is burnt explosively, with the result that the pressure and temperature within the chamber are abruptly increased.

Figure 5:
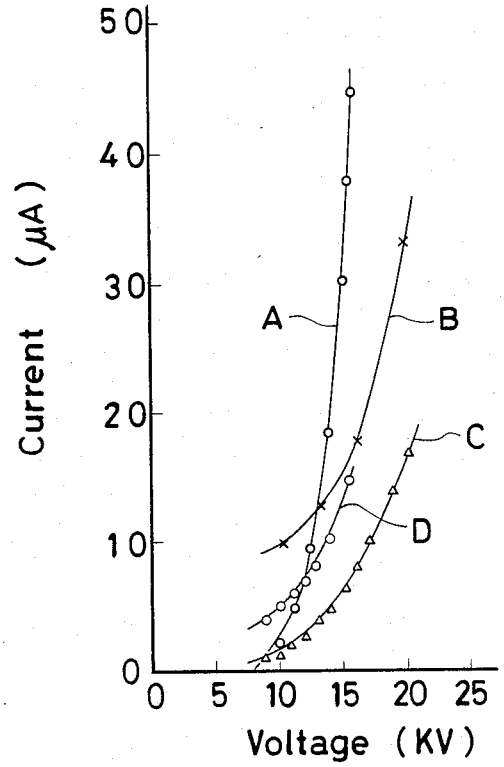
FIG. 5 is a graph showing the relation between the applied potential and the discharge current, as involved in the atomization of kerosene and ethyl alcohol in the method of this invention.

An experimental apparatus was constructed as illustrated in FIG. 1, wherein the outside diameter of the discharge electrode was 5 mm, the distance between the discharge surfaces 2*a*, 6*a* was 1.5 mm, the inside diameter of the annular electrode 9 was 75 mm, the distance separating the end surface of the porous member 8 and the electrode 9 in the axial direction (discharge gap) was 30 mm, and the flow rate of kerosene through the flow path 3 was 47 g/min. In the operation of this experimental apparatus, the relation between the applied potential and the discharge current was determined. The results were as indicated by the curve "A" in the graph of FIG. 5. In the same experimental apparatus, the space of the second flow path 4 was 2.0 mm, the porous member 8 was a porous metal of brass having a pore diameter of 20 μm, and the feed rate of ethyl alcohol was 16 g/min. Similarly, the relation between the applied potential and the discharge current was determined. The results were as indicated by the curve "B" in the graph of FIG. 5. When the space of the second flow path was 3.0 mm, the pore diameter of the porous metal was 10 μm, and the feed rate of ethyl alcohol was 1.6 g/min., the relation between the applied potential and the discharge current was as indicated by the curve "C" in the graph of FIG. 5. When a tubular electrode 0.9 mm in outside diameter and 0.6 mm in inside diameter was used as the electrode 6 and ethyl alcohol was supplied at a flow rate of 0.4 g/min. through the flow path 3, the relation between the applied potential and the discharge current was as indicated by the curve "D" in the graph of FIG. 5.

From the results of the experiment described above, it is noted that highly effective atomization of the fuels can be accomplished with an extremely small power consumption.

Figure 6:
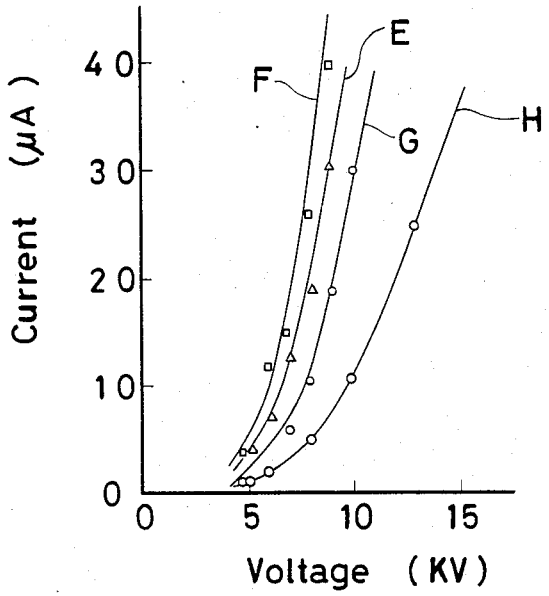
FIG. 6 is a graph showing the relation between the applied potential and the discharge current, as involved in the atomization of water and alcohol in the method of this invention.

FIG. 6 is a graph showing the relation between the applied potential and the discharge current determined by supplying alcohol and water in various mixing ratios at a flow rate of 1.5 g/min. through the flow path 3 in an experimental apparatus constructed as illustrated in FIG. 1, wherein the inside diameter of the discharge electrode was 75 mm, the discharge distance of the discharge electrode 9 was 10 mm, and the inside diameter and outside diameter of the discharge electrode 6 were respectively 0.49 mm and 0.8 mm. In the graph, the curve "E" represents the results using 100% of water, the curve "F" those using 70% of water and 30% of alcohol, the curve "G" those using 30% of water and 70% of alcohol, and the curve "H" those using 100% of alcohol. From the graph, it is noted that the applied potential was lowest when the proportion of water was 70% and that the applied potential increased when the proportion of water was increased or decreased from this particular level.

The data just described represent the relation between the applied potential and the discharge current determined by causing two liquids to pass through the two flow paths. The generation of discharge current in this case indicates that the liquids, in a combined state, are atomized in the form of finely divided particles. When a negative potential is applied to the discharge electrode 6 and a positive potential to the annular electrode 9, the two liquids should theoretically be finely divided and electrostatically combined with each other. To verify this hypothesis, an experimental apparatus was similarly built, wherein the outside diameter of the discharge electrode was 5 mm, the distance between the discharge surfaces 2*a*, 6*a* was 1.5 mm, the inside diameter of the annular electrode was 75 mm, the discharge distance was 30 mm, the diameter of the flow path was 1.5 mm, and the width of the flow path 4 was 2 mm, with porous metals of brass having a pore diameter of about 10 μm and that of about 50 μm respectively fitted to the leading ends of the flow path 3 and the flow path 4. In this experimental apparatus, kerosene was fed at a flow rate of 50 g/min. through the flow path 4 and water was fed at a flow rate of 20 g/min. through the flow path 4, a potential of −15 kV was applied to the discharge electrode and a potential of +10 kV was applied to the annular electrode. Consequently, the kerosene was sprayed in the shape of a hollow cone diverging at about 130° and the water was sprayed in the direction of the annular electrode. After passing the annular electrode, the two liquids each in the form of finely divided particles were combined with each other. When part of the combined particles were deposited on a slide glass and observed through a microscope at 400 magnifications, it was noted that at first fine particles of water were enclosed intimately with kerosene and, with elapse of time, the two liquids in the individual particles passed into each other thoroughly enough to eliminate their distinction completely.

As described above, the present invention electrically charges two liquids to opposite polarities, finely divides the charged liquids, and electrostatically combines the two masses of finely divided particles of liquids. Thus, it enables two liquids which, by nature, cannot be readily mixed to be combined intimately with each other without requiring use of any surfactant or dispersant. Since it permits effective addition of water or other additive to a fuel, it promotes energy saving and curbs occurrence of substances tending to pollute the environment. Further, this invention can be utilized for mass dilution and application of agricultural pesticides. In this case, when a positive electric charge is applied to the combined pesticide particles departing from the apparatus, the sprayed particles can be deposited fast to plants without use of any spreader.

What is claimed is:

1. A method for spray combination of a first liquid having a low dielectric constant and a second liquid having a high dielectric constant, which comprises the steps of:

passing the first liquid having a low dielectric constant through an electric field formed by applying a high potential of one polarity to a first discharge electrode formed so as to generate corona discharge and an electric field to thereby cause said first liquid to be ionized, finely divided and dispersed into finely divided particles;

spraying the second liquid having a high dielectric constant toward a second electrode defining an annular opening, said liquid being sprayed through a porous member disposed around a flow path from which said first liquid is ejected, said second electrode being adapted to generate an electric field by applying a high potential of the polarity opposite that of said first discharge electrode, to thereby cause the second liquid sprayed through said porous member to be more finely divided by secondary splitting and dispersed into finely divided particles; and combining electrostatically said finely divided particles of said first liquid charged to one polarity and finely divided particles of said second liquid charged to the polarity opposite that of said first liquid so that the combination is electrically neutral.

2. The method according to claim 1, wherein the first liquid is sprayed through a porous substance.

3. The method according to claim 1, wherein the first liquid is ionized by application of a high negative potential and the finely divided particles of the second liquid are ionized by application of a high positive potential.

4. An apparatus for the spray combination of a first liquid having a low dielectric constant and a second liquid having a high dielectric constant, which comprises:

a first flow path disposed at the center of a spray nozzle and adapted to permit said first liquid to flow, a first electrode disposed inside said first flow path and formed so as to generate corona discharge and an electric field through which said liquid passes, thereby causing said first liquid to be ejected from the open end of said first flow path in the form of dispersed finely divided particles charged to one polarity, a power source for applying a high potential of said one polarity to said first electrode, an annular second flow path formed concentrically around said first flow path and adapted to allow said second liquid to flow, a porous member disposed at the open end of said annular second flow path to finely divide the second liquid flowing therethrough, an annular electrode disposed so as to surround the open end of said annular second flow path at the leading end of said spray nozzle, and a power source for applying to said second electrode a high potential of the polarity opposite that applied to said first electrode, so as to subject the finely divided particles of said second liquid leaving said porous member to secondary splitting to establish much finer particles;

whereby finely divided particles of the first liquid charged to one polarity and finely divided particles of the second liquid charged to the polarity opposite that of said first liquid are electrostatically combined with each other and electrically neutralized.

5. The apparatus according to claim 4, wherein a porous member is additionally provided at the open end of the first flow path.

6. The apparatus according to claim 4, wherein the first flow path is additionally provided with swirl slots adapted to swirl the first liquid being passed through the first flow path.

7. The apparatus according to claim 4, wherein a gas feed path is disposed around the outer surface of the spray nozzle to promote the combination of the finely divided particles of the first liquid and those of the second liquid.

* * * * *